US010271628B2

(12) United States Patent
Liu

(10) Patent No.: US 10,271,628 B2
(45) Date of Patent: Apr. 30, 2019

(54) LEAKPROOF COSMETIC CONTAINER HAVING AN AIRTIGHT ARRANGEMENT FOR APPLICATOR

(71) Applicant: Li-Mei Liu, New Taipei (TW)

(72) Inventor: Li-Mei Liu, New Taipei (TW)

(73) Assignee: Zhuhai Ding Rong Plastic Products Co., LTD, Zhuhai (CN)

( * ) Notice: Subject to any disclaimer, the term of this patent is extended or adjusted under 35 U.S.C. 154(b) by 93 days.

(21) Appl. No.: 15/496,141

(22) Filed: Apr. 25, 2017

(65) Prior Publication Data

US 2018/0303221 A1 Oct. 25, 2018

(51) Int. Cl.
*A45D 34/04* (2006.01)
*A45D 40/26* (2006.01)

(52) U.S. Cl.
CPC ..... *A45D 34/042* (2013.01); *A45D 34/04* (2013.01); *A45D 40/26* (2013.01); *A45D 2200/051* (2013.01)

(58) Field of Classification Search
CPC . A46B 11/0089; A45D 34/042; A45D 40/262
USPC ..... 401/262
See application file for complete search history.

(56) References Cited

U.S. PATENT DOCUMENTS 5,551,789 A * 9/1996 Okawa ..... A45D 34/042 401/199
5,971,647 A * 10/1999 Loulourgas ..... B43K 23/124 401/202
7,163,350 B2 * 1/2007 Noguchi ..... A45D 34/042 401/223
7,175,360 B2 * 2/2007 Zhang ..... A45D 34/04 401/186
7,287,927 B2 * 10/2007 Zhang ..... B65D 47/42 401/270
7,988,377 B2 * 8/2011 Zhang ..... A45D 40/24 401/186
8,206,051 B2 * 6/2012 Sakurai ..... A45D 34/042 401/269
8,801,315 B2 * 8/2014 Dwyer ..... A45D 34/042 401/269
9,060,587 B2 * 6/2015 Pschirer ..... A45D 40/262
9,125,470 B2 * 9/2015 Thiebaut ..... A45D 34/04
9,867,444 B1 * 1/2018 Liu ..... A45D 34/042
10,040,082 B1 * 8/2018 Liu ..... B05B 11/0005
(Continued)

*Primary Examiner* — David P Angwin
*Assistant Examiner* — Bradley S Oliver

(57) ABSTRACT

A cosmetic container includes a hollow case including an internal annular concave surface and bottom ports; a lotion enclosure including a threaded neck; a hollow supporting frame including an annular first flange on an outer surface and rested upon the neck, a smaller annular second flange in the concave surface, a forward snapping member, and an annular projection on an inner surface; a hollow conic member including a fastening element rested upon the first flange and secured to the snapping member; an applicator partially disposed in the supporting frame, fastened by the projection, and passing through the conic member, with the applicator including a cavity with a lotion guide member disposed therein; a cap including an internally threaded section secured to the neck, an internal annular shoulder, and an annular protrusion between the shoulder and the internally threaded section; and a cup-shaped member fastened in the cap.

4 Claims, 8 Drawing Sheets

(56) References Cited

U.S. PATENT DOCUMENTS

| | | | | |
|---|---|---|---|---|
| 2007/0172307 | A1* | 7/2007 | Jo | A45D 34/042<br>401/279 |
| 2009/0269120 | A1* | 10/2009 | Kim | A45D 34/042<br>401/121 |
| 2012/0266907 | A1* | 10/2012 | Chan | A45D 34/042<br>132/218 |
| 2016/0376069 | A1* | 12/2016 | Jung | A45D 34/04<br>401/261 |

* cited by examiner

LEAKPROOF COSMETIC CONTAINER HAVING AN AIRTIGHT ARRANGEMENT FOR APPLICATOR

BACKGROUND OF THE INVENTION

1. Field of the Invention

The invention relates to cosmetic containers and, more particularly, to a leakproof cosmetic container having an airtight arrangement for an applicator.

2. Description of Related Art

A conventional cosmetic container, as a prior work of the present inventor, is shown in FIG. 8 and comprises a cap 89, a cup-shaped member 88, a supporting frame 84, a hollow conic member 87 placed on a portion of the supporting frame 84, and an applicator 85 disposed through the supporting frame 84 and the hollow conic member 87. In an inoperative position, the cap 89 is placed on the cup-shaped member 88 by threading to the threaded neck of the lotion enclosure, and an annular concave portion 92 of the cup-shaped member 88 tightly engages the hollow conic member 87. Thus, the applicator 85 is airtight.

However, the conventional cosmetic container has the following disadvantages: The annular concave portion 92 is thinner than other portions of the cup-shaped member 88. Thus, the annular concave portion 92 does not engage the cap 89. It cannot maintain airtight-ness of the applicator 85 due to elastic fatigue after a long period of time of use. Constant flow of cosmetic contents (e.g., lotion) through the applicator 85 is not possible. As a result, the cosmetic contents may leak out of the cosmetic container via the hollow conic member 87 and the cap 89. The hand of an individual owning the cosmetic container may contact the sticky cosmetic contents inadvertently. It not only causes inconvenience in use but also wastes the cosmetic contents.

Thus, the need for improvement still exists.

SUMMARY OF THE INVENTION

It is therefore one object of the invention to provide a cosmetic container comprising a hollow case including a space, an annular concave surface in the space, and a plurality of ports through a bottom; a lotion enclosure including an externally threaded neck with the hollow case partially disposed therein, and a reservoir communicating with the plurality of ports; a hollow supporting frame including an axial channel, an annular first flange on an outer surface and rested upon the externally threaded neck, an annular second flange adjacent to the annular first flange and being smaller than the annular first flange, with the annular second flange being disposed in the annular concave surface, a snapping member extending from the annular first flange to one end of the hollow supporting frame, and an annular projection on an inner surface of the axial channel; a hollow conic member including a fastening element rested upon the annular first flange and secured to the snapping member; an applicator partially disposed in the hollow supporting frame, fastened by the annular projection, and passing through the hollow conic member, with the applicator including a cavity; a lotion guide member disposed in the cavity and pointing toward one end of the applicator; a cap including an opening, an internally threaded section adjacent to the opening and configured to secure to the externally threaded neck, an annular shoulder on an intermediate portion of an inner surface, and an annular protrusion between the annular shoulder and the internally threaded section; and a cup-shaped member including an annular concave portion adjacent to one end, and an outwardly extending rim at the other end. The cup-shaped member is fastened in the cap with the outwardly extending rim engaging the annular shoulder.

Preferably, a plurality of check valves is disposed in the plurality of ports.

Preferably, a biasing member is biased between the annular second flange and the annular concave surface.

Preferably, a ratio of a thickness of the annular projection to a diameter of the axial channel is 1 to 18.

Preferably, a conic portion of the lotion guide member has a diameter to height ratio of 1:2.25.

The invention has the following advantages and benefits in comparison with the conventional art. The lotion guide member causes the applicator to control the volume of discharged lotion, thereby preventing leakage from occurring due to excessive volume of the discharged lotion. The cup-shaped member has an outwardly extending rim at an opening, with the outwardly extending rim tightly engaging the annular shoulder of the cap. Thus, the cup-shaped member and the hollow conic member are secured together. Therefore, the cup-shaped member is not subject to elastic fatigue.

The above and other objects, features and advantages of the invention will become apparent from the following detailed description taken with the accompanying drawings.

DETAILED DESCRIPTION OF THE INVENTION

Figure 1:
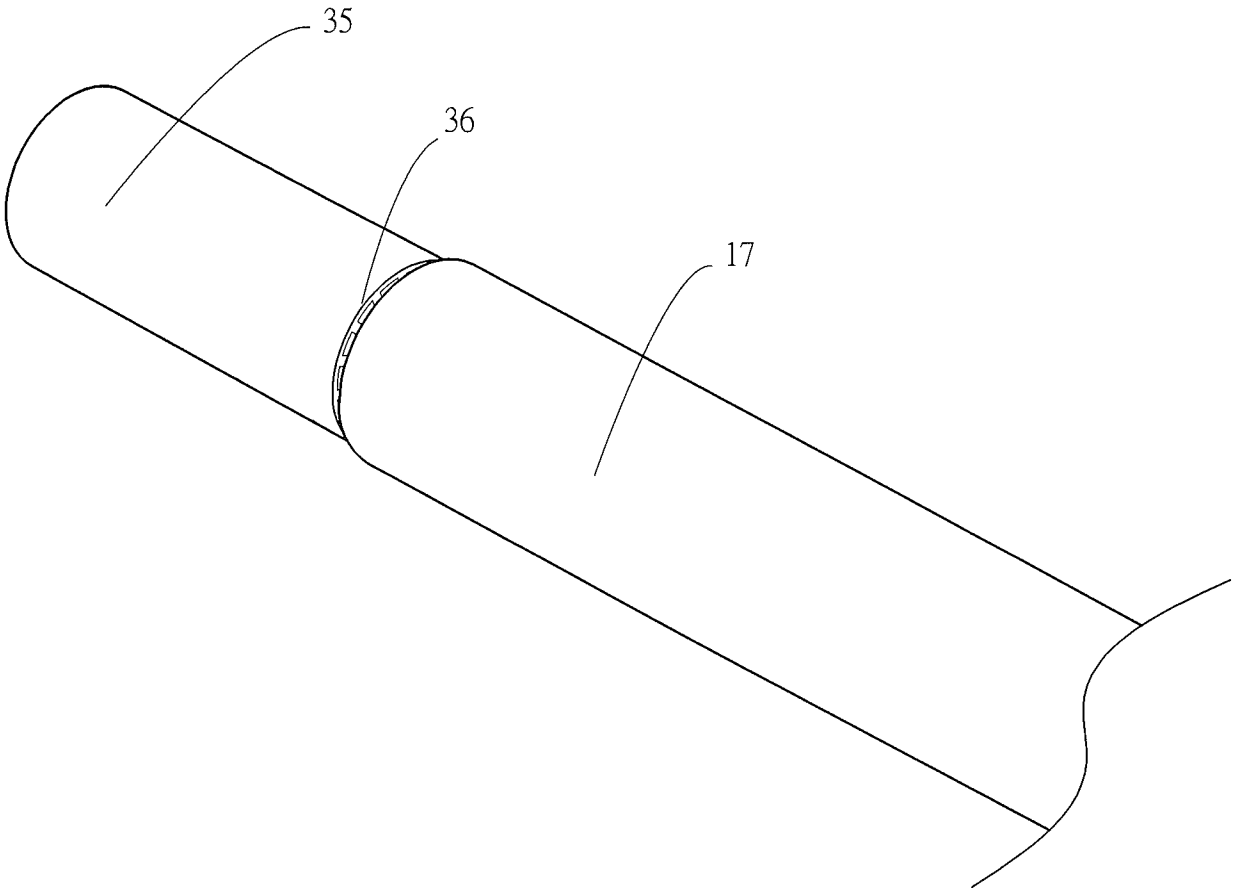
FIG. 1 is a perspective view of a cosmetic container according to a first preferred embodiment of the invention.
Figure 2:
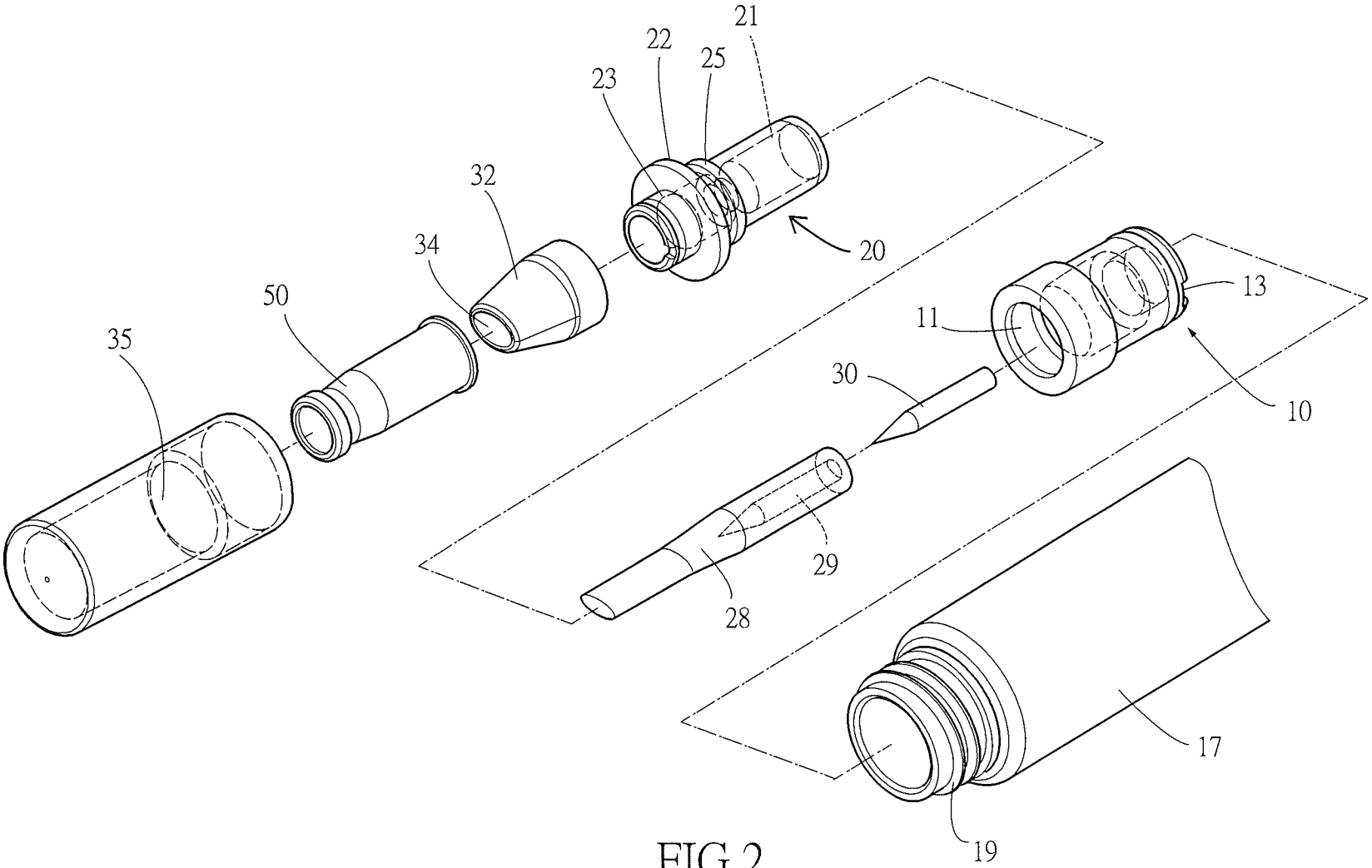
FIG. 2 is an exploded view of the cosmetic container.

Referring to FIGS. 1 to 4, a cosmetic container in accordance with the invention comprises the following components as discussed in detail below.

A hollow case 10 includes a space 11, an annular concave surface 12 in the space 11, a plurality of ports 13 through a bottom, and a plurality of check valves 14 disposed in the plurality of ports 13. A lotion enclosure 17 includes a reservoir 18 communicating with the plurality of ports 13, and an externally threaded neck 19 at an end with the hollow case 10 partially mounted therein. Lotion stored in a reservoir 18 of the lotion enclosure 17 is only allowed to flow from the reservoir 18 of the lotion enclosure 17 to the hollow case 10 through the plurality of ports 13 due to the provision of the plurality of check valves 14. A hollow supporting frame 20 includes an axial channel 21, an annular first flange 22 on an outer surface and rested upon one end of the hollow case 10, an annular second flange 25 beside the annular first flange 22 and smaller than the annular first flange 22, with the annular second flange 25 being disposed at the other end of the annular concave surface 12, a sleeve member 24 defined from the annular second flange 25 to one end of the hollow supporting frame 20 and disposed in the hollow case 10, a snapping member 23 defined from the annular first flange 22 to one end of the hollow supporting frame 20, an annular projection 26 on an inner surface of the axial channel 21 and adjacent to the annular second flange 25, an applicator 28 partially disposed in the hollow supporting frame 20 and fastened by the annular projection 26, and a cavity 29 formed in the applicator 28.

A lotion guide member 30 is complementarily disposed in the cavity 29 and has its tapered end pointing toward one end of the applicator 28. The conic portion of the lotion guide member 30 has a diameter to height ratio of 1:2.25. A hollow conic member 32 is provided with a fastening element 33 at the other end, with the fastening element 33 being rested upon the annular first flange 22 and secured to the snapping member 23. An opening 34 is provided at one end of the hollow conic member 32 to allow the applicator 28 to pass through. A cap 35 includes an opening 36, an internally threaded section 37 adjacent to the opening 36, an annular shoulder 39 on an intermediate portion of an inner surface, and an annular protrusion 38 between the annular shoulder 39 and the internally threaded section 37. The internally threaded section 37 is threadedly secured to the externally threaded neck 19 when the cosmetic container is closed. A cup-shaped member 50 includes an annular concave portion 51 adjacent to one end, and an outwardly extending rim 52 at the other end. The cup-shaped member 50 is fastened in the cap 35 with the outwardly extending rim 52 complimentarily engaged the annular shoulder 39.

Preferably, the ratio of thickness of the annular projection 26 to diameter of the axial channel 21 is 1 to 18. The thickness of the annular projection 26 is crucial to the success of the fastening of the applicator 28 in the hollow supporting frame 20.

Preferably, the lotion guide member 30 is made of rubber or a polymeric material.

Figure 3:
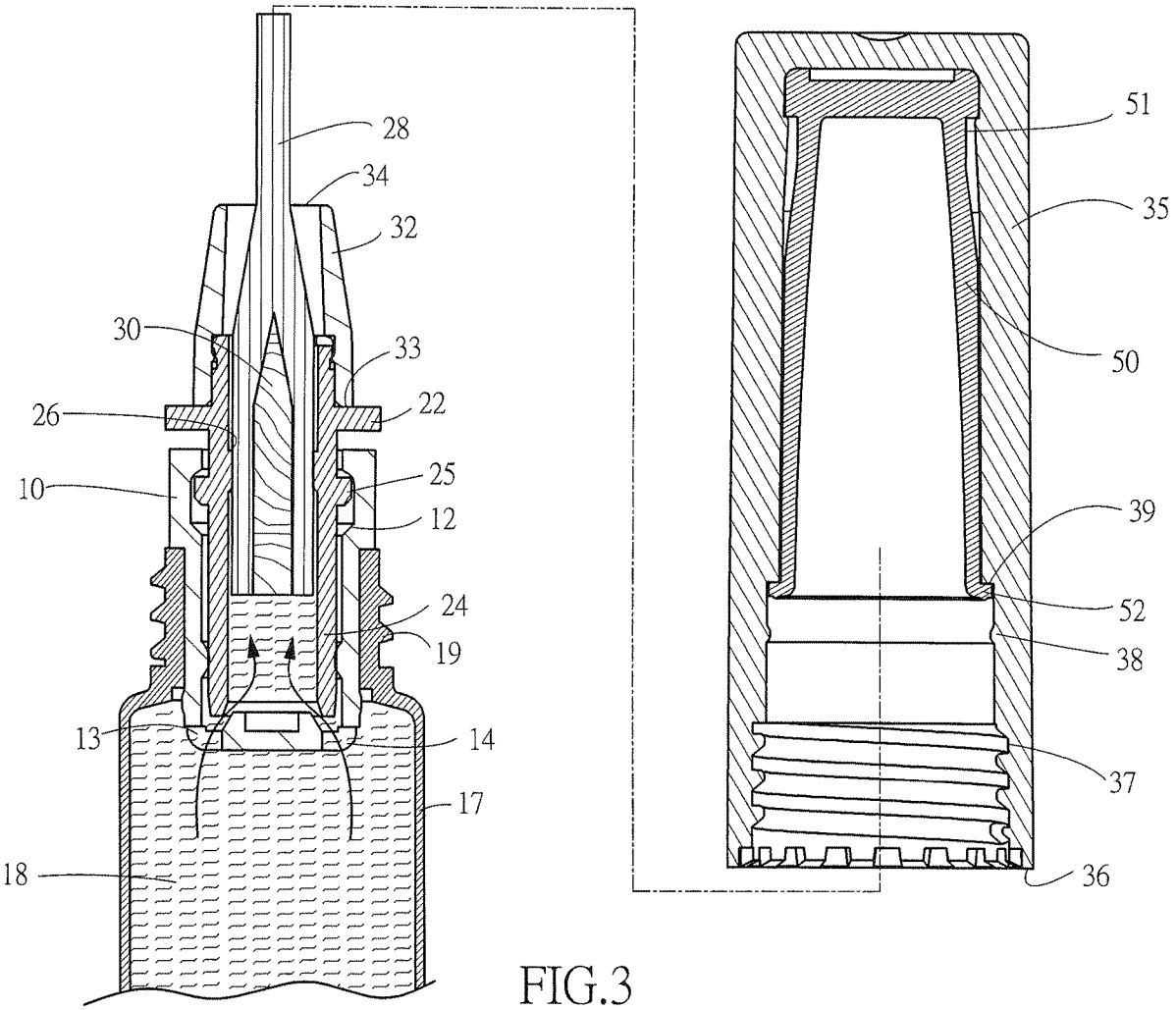
FIG. 3 is a longitudinal sectional view of the cosmetic container with the cap being detached to show lotion flows.

As shown in FIG. 3 specifically, in a lotion dispensing operation, in response to counterclockwise rotating the cap 35 to unfasten the cap 35, the outwardly extending rim 52 disengages from the annular first flange 22, and the annular protrusion 38 moves the hollow supporting frame 20 toward the annular concave portion 51. In turn, the sleeve member 24 moves to open the plurality of check valves 14. Further, lotion in the reservoir 18 flows to the hollow case 10 by passing through the plurality of ports 13. As a result, lotion flows out of the applicator 28 in a controlled way.

Figure 4:
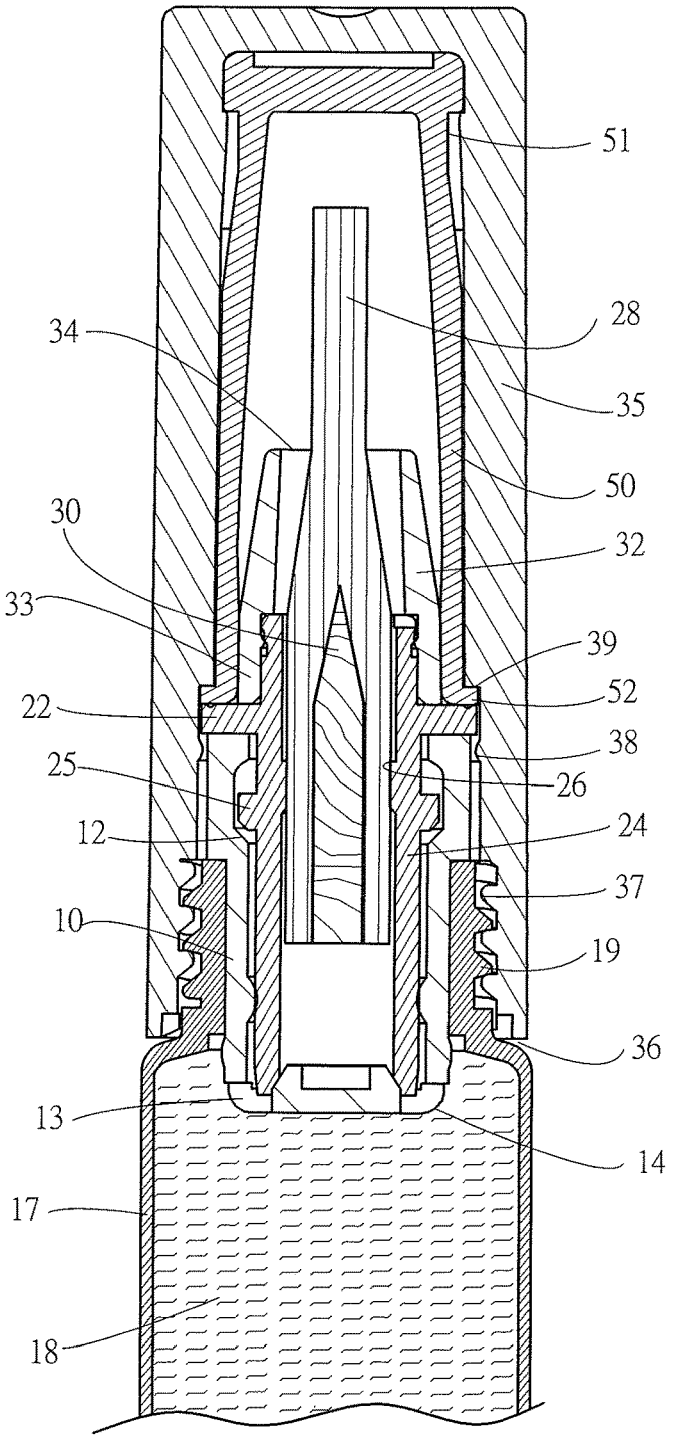
FIG. 4 is a view similar to FIG. 3 with the cap being put on in a closed state.

As shown in FIG. 4 specifically, in a closed state of the cosmetic container, the cap 35 is threadedly secured to the lotion enclosure 17. Also, the outwardly extending rim 52 urges against the annular first flange 22, the sleeve member 24 blocks the plurality of check valves 14 to prevent the lotion from flowing through the plurality of ports 13. Further, the fastening element 33 of the hollow conic member 32 is clamped by the cup-shaped member 50. As a result, the applicator 28 is kept airtight.

Figure 5:
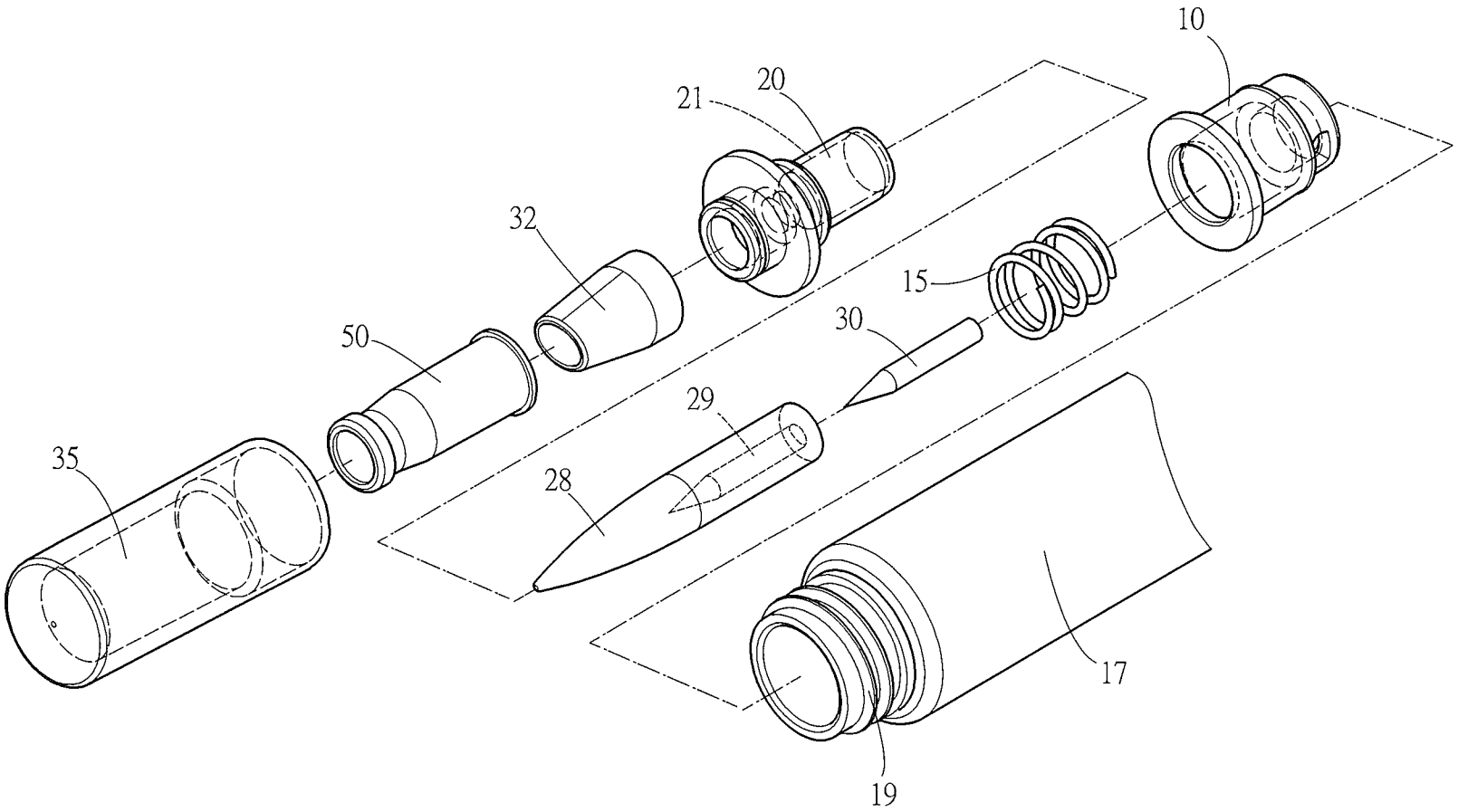
FIG. 5 is an exploded view of a cosmetic container according to a second preferred embodiment of the invention.
Figure 6:
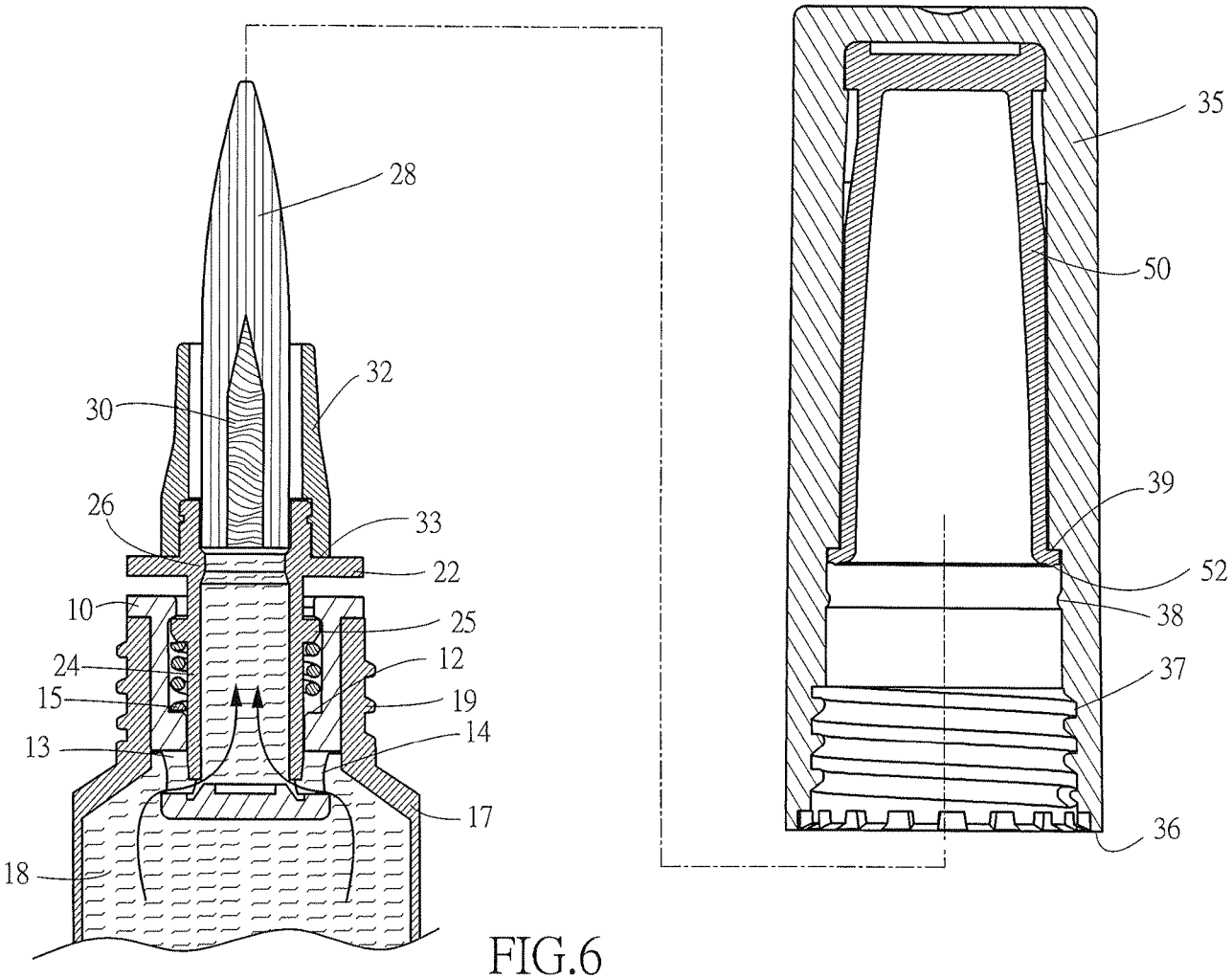
FIG. 6 is a longitudinal sectional view of the cosmetic container of FIG. 5 with the cap being detached to show lotion flows.
Figure 7:
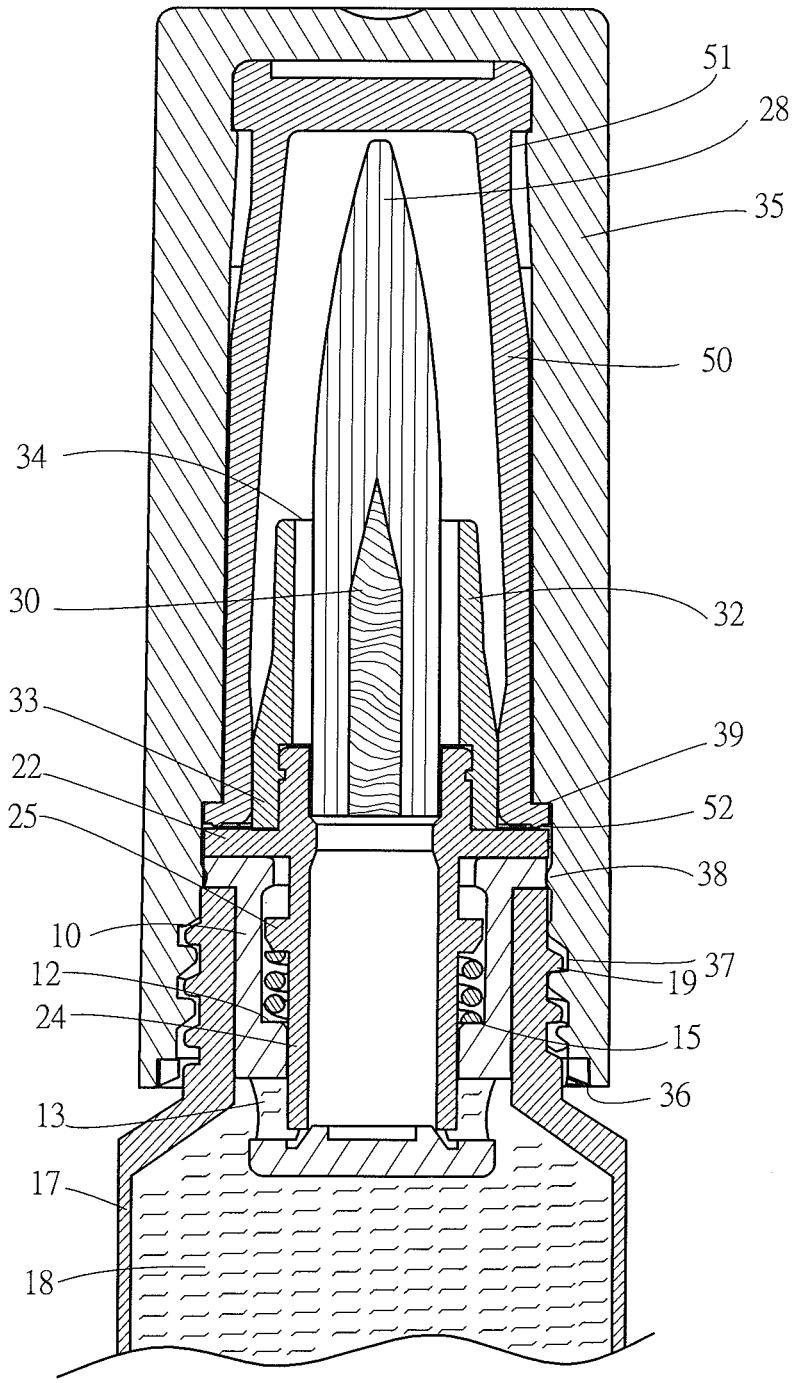
FIG. 7 is a view similar to FIG. 6 with the cap being put on in a closed state.
Figure 8:
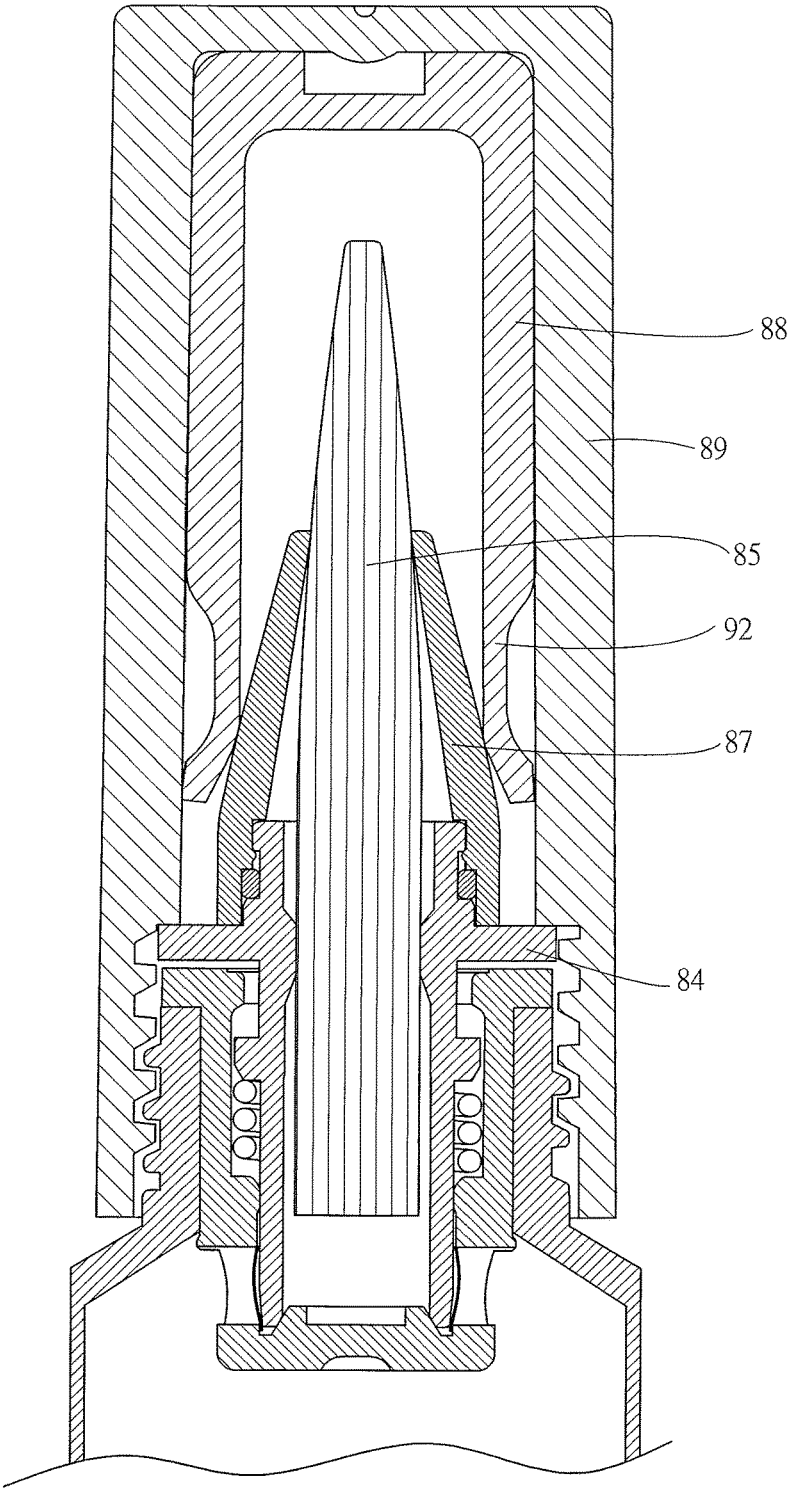
PRIOR ART FIG.8
FIG. 8 is a longitudinal sectional view of the head portion of a conventional cosmetic container.

Referring to FIGS. 5 to 7, a cosmetic container in accordance with a second preferred embodiment of the invention is shown. The characteristics of the second preferred embodiment are substantially the same as that of the first preferred embodiment except the following: A torsion spring 15 is biased between the annular second flange 25 and the annular concave surface 12. The torsion spring 15 can be replaced by any biasing member.

As shown in FIG. 6 specifically, in a lotion dispensing operation, in response to counterclockwise rotating the cap 35 to unfasten the cap 35, the outwardly extending rim 52 disengages from the annular first flange 22, and the annular protrusion 38 moves the supporting frame 20 toward a bottom of the cup-shaped member 50. In turn, the torsion spring 15 expands to move the annular second flange 25. Further, the sleeve member 24 moves to open the plurality of check valves 14. Furthermore, lotion in the reservoir 18 flows to the hollow case 10 through the plurality of ports 13. As a result, lotion flows out of the applicator 28 in a controlled manner.

As shown in FIG. 7 specifically, in a closed state of the cosmetic container, the cap 35 is threadedly secured to the lotion enclosure 17. Also, the outwardly extending rim 52 urges against the annular first flange 22, the torsion spring 15 is compressed by the annular second flange 25, and the sleeve member 24 blocks the plurality of check valves 14 to prevent the lotion from flowing through the plurality of ports 13. Further, the fastening element 33 of the hollow conic member 32 is clamped by the cup-shaped member 50. As a result, the applicator 28 is kept airtight.

While the invention has been described in terms of preferred embodiments, those skilled in the art will recognize that the invention can be practiced with modifications within the spirit and scope of the appended claims.

What is claimed is:

1. A cosmetic container comprising:

a hollow case including a space, an annular concave surface in the space, and a plurality of ports through a bottom;

a lotion enclosure including an externally threaded neck with the hollow case partially disposed therein, and a reservoir communicating with the plurality of ports;

a hollow supporting frame including an axial channel, an annular first flange on an outer surface and rested upon the externally threaded neck, an annular second flange adjacent to the annular first flange and being smaller than the annular first flange, with the annular second flange being disposed in the annular concave surface, a snapping member extending from the annular first flange to one end of the hollow supporting frame, and an annular projection on an inner surface of the axial channel, wherein a ratio of a thickness of the annular projection to a diameter of the axial channel is 1 to 18;

a hollow conic member including a fastening element rested upon the annular first flange and secured to the snapping member;

an applicator partially disposed in the hollow supporting frame, fastened by the annular projection, and passing through the hollow conic member, with the applicator including a cavity;

a lotion guide member disposed in the cavity and pointing toward one end of the applicator;

a cap including an opening, an internally threaded section adjacent to the opening and configured to secure to the externally threaded neck, an annular shoulder on an intermediate portion of an inner surface, and an annular protrusion between the annular shoulder and the internally threaded section; and a cup-shaped member including an annular concave portion adjacent to one end, and an outwardly extending rim at another end, wherein the cup-shaped member is fastened in the cap with the outwardly extending rim engaged the annular shoulder.

2. The cosmetic container of claim 1, further comprising a plurality of check valves disposed in the plurality of ports.

3. The cosmetic container of claim 1, further comprising a biasing member biased between the annular second flange and the annular concave surface.

4. The cosmetic container of claim 1, wherein a conic portion of the lotion guide member has a diameter to height ratio of 1:2.25.

* * * * *